US006749521B1

(12) United States Patent
Benson

(10) Patent No.: US 6,749,521 B1
(45) Date of Patent: Jun. 15, 2004

(54) EXTENDABLE GOLF CLUB HAVING INTERLOCKABLE SPACER SEGMENTS

(75) Inventor: Shawn B. Benson, Lenexa, KS (US)

(73) Assignee: On Track Sports, L.L.C., Dearfield, IL (US)

( * ) Notice: Subject to any disclaimer, the term of this patent is extended or adjusted under 35 U.S.C. 154(b) by 0 days.

(21) Appl. No.: 10/304,517

(22) Filed: Nov. 25, 2002

(51) Int. Cl.[7] ..... A63B 53/10; A63B 53/12
(52) U.S. Cl. ..... 473/239; 473/296
(58) Field of Search ..... 473/239, 296, 473/297, 298, 299, 306, 307

(56) References Cited

U.S. PATENT DOCUMENTS

| | | | | |
|---|---|---|---|---|
| 1,650,183 A | | 11/1927 | Brooks | |
| 1,665,988 A | | 4/1928 | Smith | |
| 1,972,653 A | | 9/1934 | Heart | |
| 1,994,069 A | | 3/1935 | Fletcher | |
| 3,102,726 A | | 9/1963 | Barrett | |
| 3,424,464 A | | 1/1969 | Greenhouse | |
| 3,722,604 A | | 3/1973 | Lesher | |
| 3,756,635 A | * | 9/1973 | Beers | 312/111 |
| 3,829,092 A | | 8/1974 | Arkin | |
| 4,340,227 A | * | 7/1982 | Dopkowski | 473/288 |
| 4,452,456 A | * | 6/1984 | Kochevar | 473/409 |
| 4,600,195 A | | 7/1986 | Hunter | |
| 4,682,774 A | | 7/1987 | Holy | |
| 4,693,475 A | * | 9/1987 | Keilhau | 473/552 |
| 5,024,438 A | | 6/1991 | Candow | |
| 5,029,860 A | | 7/1991 | Ehrich | |
| 5,282,619 A | | 2/1994 | Napolitano et al. | |
| 5,328,174 A | | 7/1994 | Reeder | |
| 5,452,891 A | | 9/1995 | Thomas | |
| 5,496,029 A | | 3/1996 | Heath et al. | |
| 5,609,255 A | | 3/1997 | Nichols | |
| 5,609,336 A | | 3/1997 | Tashjian | |
| 5,616,087 A | | 4/1997 | Bothwell | |
| 5,823,892 A | | 10/1998 | Kuo | |
| 5,924,937 A | | 7/1999 | Kuo | |
| 5,997,412 A | * | 12/1999 | Benson | 473/296 |
| 6,012,989 A | * | 1/2000 | Saksun, Sr. | 473/341 |
| 6,088,868 A | | 7/2000 | Cerveny | |

FOREIGN PATENT DOCUMENTS

| | | | |
|---|---|---|---|
| GB | 2225959 | * | 6/1990 |

* cited by examiner

*Primary Examiner*—Stephen Blau
(74) *Attorney, Agent, or Firm*—Hovey Williams LLP

(57) ABSTRACT

An extendable golf club having threadably intercoupled upper and lower shaft sections. The golf club can be extended by threadably coupling one or more spacers between the upper and lower shaft sections and tightening a set screw into engagement with a spacer.

24 Claims, 1 Drawing Sheet

48
50
52
38
56
54
58
42
46
40
44
16
15
10
20
22
32
26
12
24
18
14

32
16d
16c
16b
16a
26
36
32
40
35
16c
16b
16a
29
26

15
30
20
34
40
35
32
36
16c
16b
16a
29
26
28
18
24

40
62
46
60
32
36

EXTENDABLE GOLF CLUB HAVING INTERLOCKABLE SPACER SEGMENTS

BACKGROUND OF THE INVENTION

1. Field of the Invention

The present invention relates generally to athletic equipment having shafts which can be adjusted in length. In another aspect, the invention concerns a golf club having a shaft which is extendable to accommodate a user's increased height.

2. Description of the Prior Art

The game of golf is becoming increasingly popular with both adults and children. As a result of golf's popularity among children, manufacturers now produce golf clubs in a variety of lengths to accommodate people of all sizes. However, purchasing a golf club of a shorter length does not allow a growing child to use the club for very long. As the young golfer grows, he or she must continually replace the club as it becomes too short for proper use.

Prior art golf clubs employing extendable shafts typically have one or all of the following disadvantages: (1) The extendable shaft is not strong enough to withstand repeated impacting of a standard golf ball; (2) the extendable shaft is too heavy compared to high quality non-extendable shafts; (3) the extendable shaft is not sufficiently flexible relative to high quality non-extendable shafts; (4) the extendable shaft is difficult to properly extend; and/or (5) the extendable shaft is not as aesthetically pleasing as a standard shaft due to the irregular shape of the shaft segments and the joints between shaft segments.

OBJECTS AND SUMMARY OF THE INVENTION

It is, therefore, an object of the present invention to provide an extendable golf club having a shaft that is similar in weight, strength, flexibility, and appearance to a standard, non-extendable, high quality golf club shaft.

A further object of the invention is to provide an extendable golf club employing a relatively simple method of extending the length of the golf club shaft.

A still further object of the present invention is to provide an extendable golf club that utilizes substantially identical shaft-lengthening spacer segments, thereby reducing the overall cost of manufacturing the extendable golf club.

It should be understood that the above-listed objects of the present invention need not all be accomplished by the invention claimed herein. Further objects and advantages of the present invention will be apparent from the following detailed description of the preferred embodiment, claims, and drawing figures.

Accordingly, in one embodiment of the present invention, there is provided an extendable golf club comprising a shaft and a first spacer for lengthening the shaft. The shaft includes a first section, a second section, and a set screw threadably received in the first section. The golf club is shiftable from a first configuration wherein the first spacer is entirely detached and spaced from the shaft to a second configuration wherein the first spacer is coupled between the first and second sections to thereby lengthen the shaft relative to the first configuration. The set screw engages the second section when the golf club is in the first configuration, thereby releasably coupling the first and second sections to one another. The set screw engages the first spacer when the golf club is in the second configuration, thereby releasably coupling the first section and the first spacer to one another.

In accordance with another embodiment of the present invention, there is provided an extendable golf club comprising a shaft and a first spacer for lengthening the shaft. The shaft includes first and second sections. The golf club is shiftable from a first configuration wherein the first spacer is entirely detached and spaced from the shaft to a second configuration wherein the first spacer is threadably coupled between the first and second sections to thereby lengthen the shaft relative to the first configuration. The first and second sections are threadably intercoupled when the golf club is in the first configuration. The first spacer includes an adhesive capsule when the golf club is in the first configuration. The adhesive capsule is adapted to rupture when the golf club is shifted from the first configuration to the second configuration to thereby permanently couple the first spacer to the second section.

In a further embodiment of the present invention, there is provided an extendable golf club comprising a shaft and a first spacer for lengthening the shaft. The shaft includes a first section, a second section, and a set screw threadably received in the first section. The golf club is shiftable from a first configuration wherein the first spacer is entirely detached and spaced from the shaft to a second configuration wherein the first spacer is threadably coupled between the first and second sections to thereby lengthen the shaft relative to the first configuration. The first section includes a female end portion, while the second section includes a male end portion. The male end portion is threadably received in the female end portion with the set screw engaging the male end portion when the golf club is in the first configuration. The first spacer includes a male projection and a female opening. The male end portion of the second section is threadably received in the female opening of the first spacer and the male projection of the first spacer is threadably received in the female end portion of the first section when the golf club is in the second configuration. The set screw engages the male projection of the first spacer when the golf club is in the second configuration. The first spacer includes an adhesive capsule located in the female opening when the golf club is in the first configuration. The adhesive capsule is adapted to be ruptured by the male end portion of the second section when the golf club is shifted from the first configuration to the second configuration, thereby permanently fixing the first spacer to the second section.

In a still further embodiment of the present invention, there is provided a method of lengthening a golf club having a threadably interconnectable first and second shaft sections. The method comprises the steps of: (a) loosening a set screw threadably received in the first shaft section, thereby shifting the set screw out of engagement with the second shaft section; (b) unscrewing the second shaft section from the first shaft section, thereby decoupling the shaft sections from one another; (c) threadably coupling a first spacer between the first and second shaft sections, thereby lengthening the golf club; and (d) tightening the set screw into engagement with the first spacer, thereby releasably locking the first spacer to the first shaft section.

BRIEF DESCRIPTION OF THE DRAWING FIGURES

A preferred embodiment of the present invention is described in detail below with reference to the attached drawing figures, wherein.

Figures 1, 2, 3, 4, 5, 6:
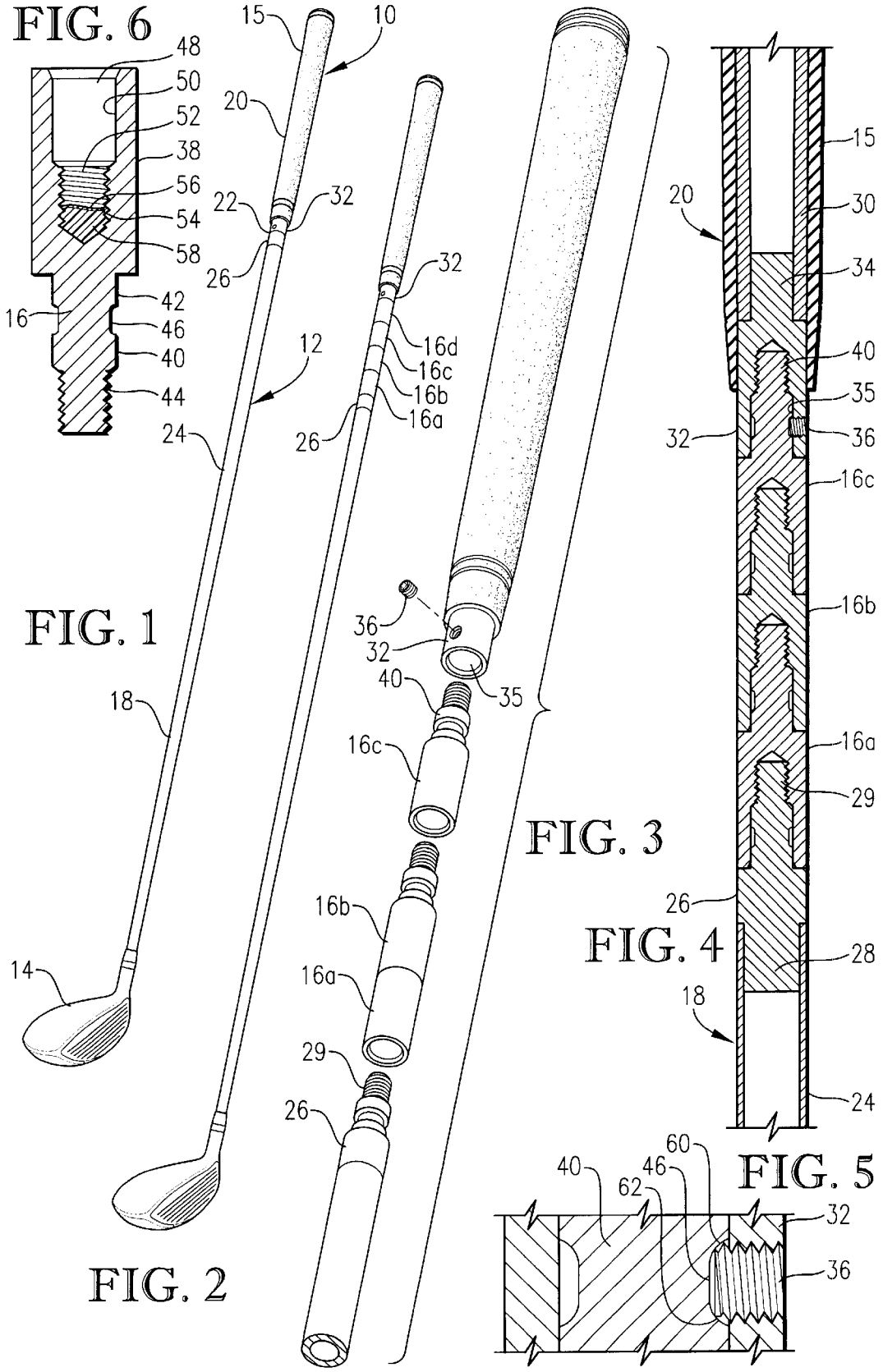
FIG. 1 is an isometric view of an extendable golf club constructed in accordance with the principles of the present invention, illustrating the golf club in a fully retracted configuration.
FIG. 2 is an isometric view of the extendable golf club, illustrating the golf club in an extended configuration with a plurality of spacers coupled to the shaft of the golf club.
FIG. 3 is an enlarged isometric assembly view of the upper portion of the golf club shaft, particularly illustrating the manner in which the spacers can be coupled to one another and coupled between the upper and lower sections of the shaft.
FIG. 4 is a sectional side view of the upper portion of the shaft in an extended configuration, particularly illustrating the manner in which the spacers are coupled to the upper and lower shaft sections.

FIG. 5 is an enlarged sectional view of the connection between one of the spacers and the upper shaft section, particularly illustrating the manner in which a set screw threadably received in the upper shaft section extends into and engages a recess in the spacer; and FIG. 6 is an enlarged sectional view of one of the spacers, particularly illustrating an epoxy capsule that is located in a female opening of the spacer and suitable for permanently fixing the spacer to a threaded male projection extending into the female opening of the spacer.

DETAILED DESCRIPTION OF THE PREFERRED EMBODIMENT

Referring initially to FIGS. 1 and 2, an extendable golf club 10 is illustrated as generally comprising an extendable shaft 12, a golf club head 14 coupled to a normally-lower end of shaft 12, and a golf club grip 15 coupled to a normally-upper end of shaft 12. Club head 14 and grip 15 can be any conventional golf club head and grip known in the art. Shaft 12 is shiftable between a retracted configuration (shown in FIG. 1) and an extended configuration (shown in FIG. 2). When shaft 12 is in the extended configuration (shown in FIG. 2), shaft 12 includes one or more substantially identical spacers 16.

Shaft 12 generally includes a lower shaft section 18, to which club head 14 is coupled, and an upper shaft section 20, to which grip 15 is coupled. When golf club 10 is in the retracted configuration (shown in FIG. 1), lower and upper shaft sections 18,20 are joined to one another at a joint 22. It is preferred for joint 22 to be located proximate grip 15 to thereby provide a stronger and more flexible shaft 12. Preferably, joint 22 is spaced less than 4 inches from the bottom end of grip 15, more preferably less than 2 inches from grip 15, and most preferably less than 1.5 inches from grip 15. Further, it is preferred for lower shaft section 18 to be at least 1.5 times longer than upper shaft section 20. Most preferably, lower shaft section 18 is at least twice as long as upper shaft section 20.

Referring now to FIGS. 1–4, lower shaft section 18 includes a flexible member 24 and a male end piece 26. Flexible member 24 is preferably formed of a flexible material known in the art to be suitable for forming high quality standard golf club shafts. Preferably, flexible member 24 is a generally cylindrical tubular member formed of steel or graphite. Male end piece 26 is rigidly coupled to the end of flexible member 24 that is generally opposite the end of flexible member 24 to which golf club head 14 is attached. Male end piece 26 can be coupled to flexible member 24 by extending an attachment projection 28 (shown in FIG. 4) of male end piece 26 into an opening in the end of flexible member 24 and permanently securing projection 28 to flexible member 24 using a suitable adhesive, solder, weld, or other permanent attachment means. It is preferred for male end piece 26 to be made of a material that is more rigid than the material from which flexible member 24 is formed. Preferably, male end piece 26 is formed of a high-strength, low-weight metal alloy. More preferably, male end piece 26 is formed of an aluminum alloy. Most preferably, male end piece 26 is formed of 6061 aluminum alloy. Male end piece 26 includes a threaded projection 29 that will be described in detail below.

Upper shaft section 20 includes a handle 30 (shown in FIG. 4) and a female end piece 32. Handle 30 is preferably formed of a material that is similar to the material from which flexible member 24 of lower shaft section 18 is formed. Female end piece 32 is rigidly coupled to handle 30 via extension of an attachment projection 34 (shown in FIG. 4) into an opening in the end of handle 30, and permanently fixing projection 34 in handle 30 with a suitable adhesive, solder, weld, or other permanent attachment means. Preferably, grip 15 covers substantially all of handle 30, as well as the otherwise exposed joint between handle 30 and female end piece 32. Female end piece 32 is preferably formed of the same material used to make male end piece 26. Referring to FIGS. 3 and 4, female end piece 32 defines a threaded opening 35 adapted to threadably receive either threaded projection 29 of male end piece 26 or a male projection 40 of a spacer 16. Female end piece 32 includes a set screw 36 that is threadably received in an opening in the wall defining threaded opening 35 in female end piece 32. Set screw 36 can be shifted into and out of engagement with a threaded male projection (e.g., threaded projection 29 or male projection 40) extending into female end piece 32 via rotation of set screw 36 relative to female end piece 32.

Referring to FIG. 4, in order to insure that the connection between handle 30 and female end piece 32 maintains sufficient rigidity and structural integrity, it is preferred for the inside diameter of handle 30 to be substantially parallel (i.e., untapered) at the location where attachment projection 34 is inserted into handle 30. The untapered portion of the inside diameter preferably extends at least one inch inward from the end of handle 30 to which female end piece 32 is attached. More preferably, the untapered portion extends 1.5 to 2.5 inches inward from the end of handle 30. Most conventional golf club shafts have tapered inside and outside diameters that get narrower toward the head of the club. Similarly, it is preferred for the outside diameter of shaft 12 to taper toward club head 14; however, the inside diameter of handle 30 proximate female end piece 32 should be untapered so as to provide a sufficiently rigid and durable connection between handle 30 and female end piece 32. In a similar fashion, it is preferred for the inside diameter of flexible member 24 of lower shaft section 18 to be untapered at the location where male end piece 26 is coupled to flexible member 24 via attachment projection 28.

Referring now to FIG. 6, each spacer 16 is formed out of the same material from which male end piece 26 is formed. Spacer 16 includes a barrel 38 and male projection 40. Barrel 38 preferably presents a substantially smooth cylindrical outer surface. Male projection 40 extends axially from one end of barrel 38. Male projection 40 includes an unthreaded portion 42 proximate barrel 38 and a threaded portion 44 spaced from barrel 38. A circumferential recess 46 is defined within unthreaded portion 42 of male projection 40. Barrel 38 defines a female opening 48 that extends into barrel 38 from the end of barrel 38 opposite the end of barrel 38 from which male projection 40 extends. Female opening 48 generally includes an unthreaded portion 50 and a threaded portion 52. It is preferred for female opening 48 to be configured so that a male projection identical to male projection 40 can be snugly and threadably received in female opening 48. An adhesive capsule 54 is disposed in female opening 48 proximate threaded portion 52. Adhesive capsule 54 generally includes a dried adhesive film 56 sealingly containing a liquid adhesive 58. Adhesive capsule 54 is adapted to rupture when a threaded male projection (e.g., threaded projection 29 or male projection 40) is threaded into female opening 48 and punctures dried adhesive film 56. Preferably, liquid adhesive 58 is an epoxy or other chemical bonding agent. One example of a suitable adhesive that can be used to make adhesive capsule 54 is available from Henkel Loctite Corporation of Rocky Hill, Conn. under the commercial designation "Loctite® 204 Threadlocker."

Referring to FIGS. 2, 4, and 6, threaded projection 29 of male end piece 26 (shown in FIGS. 2 and 4) has substantially the same configuration as male projection 40 of spacer 16 (shown in FIG. 6). Threaded opening 35 of female end piece 32 (shown in FIGS. 2 and 4) preferably has substantially the same configuration as female opening 48 of spacer 16 (shown in FIG. 6); however, threaded opening 35 in female end piece 32 does not include an adhesive capsule. Thus, when golf club 10 is in an extended configuration (shown in FIGS. 2 and 4), male projection 40 of spacer 16 is threadably received in threaded opening 35 of female end piece 32, with set screw 36 engaging male projection 40 to thereby releasably couple spacer 16 to female end piece 32 of upper shaft section 20. When golf club 10 is in an extended configuration, threaded projection 29 of male end piece 26 is threadably received in female opening 48 of spacer 16*a*, and spacer 16*a* is permanently fixed to male end piece 26 via adhesive from adhesive capsule 54.

Referring to FIG. 5, it is preferred for recess 46 in male projection 40 of spacer 16 to be at least partly defined by first and second sloped side walls 60,62. When golf club 10 is in an extended configuration, the end of set screw 36 is received in recess 46 and contacts both sloped side walls 60,62. Such a configuration of set screw 36 engaging sloped side walls 60,62 of male projection 40 not only prevents rotation of spacer 16 relative to female end piece 32, but also restricts axial translational movement of spacer 16 relative to female end piece 32.

Referring to FIGS. 1 and 4, when golf club 10 is in the fully retracted configuration (shown in FIG. 1), threaded projection 29 of male end piece 26 is threadably received in threaded opening 35 in female end piece 32, with set screw 36 engaging threaded projection 29 of male end piece 26 to thereby releasably couple lower shaft section 18 to upper shaft section 20. As described above with respect to the coupling of spacer 16 to female end piece 32, when golf club 10 is in the retracted configuration, set screw 36 preferably engages first and second sloped side walls of the recess defined in threaded projection 29 of male end piece 26 to thereby restricting both rotational and axial translational shifting of male end piece 26 relative to female end piece 32.

Referring to FIGS. 1–6 in combination, in operation, golf club 10 can be incrementally extended from the fully retracted configuration (shown in FIG. 1) to the fully extended configuration (shown in FIG. 2) by incrementally adding spacers 16*a*–*d* to shaft 12 between lower and upper shaft sections 18,20. In order to shift golf club 10 from the fully retracted configuration (shown in FIG. 1) to a first extended configuration (where one spacer 16*a* is received in shaft 12), set screw 36 is loosened out of engagement with threaded projection 29 of male end piece 26, male end piece 26 is unthreaded from female end piece 32, first spacer 16*a* is threadably coupled to male end piece 26 and female end piece 32, and set screw 36 is tightened into engagement with male projection 40 of first spacer 16*a* to thereby releasably couple first spacer 16*a* to female end piece 32. When first spacer 16*a* is threadably coupled to male end piece 26, threaded projection 29 of male end piece 26 automatically ruptures adhesive capsule 54 in female opening 48 of first spacer 16*a*. The liquid adhesive 58 released from adhesive capsule 54 is operable to permanently fix first spacer 16*a* to male end piece 26 of lower shaft section 18.

When it is desired to shift golf club 10 from the first extended configuration to a second extended configuration (where two spacers 16*a*,*b* are received in shaft 12), set screw 36 can be loosened out of engagement with male projection 40 of first spacer 16*a*, female end piece 32 can be unthreaded from first spacer 16*a*, second spacer 16*b* can be threadably coupled to first spacer 16*a* and female end piece 32, and set screw 36 can be tightened into engagement with male projection 40 of second spacer 16*b* to thereby releasably couple second spacer 16*b* to female end piece 32. When male projection 40 of first spacer 16*a* is threaded into female opening 48 of second spacer 16*b*, adhesive capsule 54 of second spacer 16*b* is ruptured by male projection 40 of first spacer 16*a*. The liquid adhesive 58 released from epoxy capsule 54 of second spacer 16*b* is operable to permanently fix second spacer 16*b* to first spacer 16*a*.

Golf club 10 can be incrementally lengthened in accordance with the above-described steps as the user of club 10 requires extension of shaft 12. It is preferred for golf club 10 to be sold in a kit that includes 2 to 8 spacers 16, more preferably 3 to 6 spacers 16, and most preferably 4 spacers 16. It is preferred for barrel 38 of each spacer 16 to have a length in the range of from about 0.25 to about 2 inches, more preferably in the range of from about 0.5 to about 1.5 inches, and most preferably in the range of from 0.75 to 1.25 inches, thereby providing optimal incremental extension of shaft 12.

Referring to FIGS. 2 and 4, it is also preferred for barrel 38 of spacers 16 to present a substantially smooth cylindrical outer surface having a diameter that is substantially the same as the diameter of lower and upper shaft sections 18, 20 proximate spacers 16. Thus, even when golf club 10 is in the fully extended configuration (shown in FIG. 2), shaft 12 has a substantially smooth, regular outer surface with an appearance similar to that of a standard non-extendable golf club shaft. Further, the threads on threaded projection 29, male projection 40, threaded opening 35, and female opening 48 should be configured such that the threaded connections in shaft 12 are tightened by the torsional force exerted on shaft 12 when club head 14 is used to strike a standard golf ball.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. An extendable golf club comprising:

a shaft including a first section, a second section, and a set screw threadably received in the first section; and a first spacer for lengthening the shaft, said golf club being shiftable from a first configuration wherein the first spacer is entirely detached and spaced from the shaft to a second configuration wherein the first spacer is coupled between the first and second sections to thereby lengthen the shaft relative to the first configuration, said set screw engaging the second section when the golf club is in the first configuration, thereby releasably coupling the first and second sections to one another, said set screw engaging the first spacer when the golf club is in the second configuration, thereby releasably coupling the first section and the first spacer to one another, said first spacer including a generally cylindrical barrel presenting first and second ends, said first spacer including a male projection extending from the first end of the barrel, said first spacer defining a female opening extending inwardly from the second end of the barrel, said male projection defining a circumferential recess, said set screw being received in the circumferential recess when the golf club is in the second configuration.

2. The extendable golf club of claim 1, said first and second sections being threadably coupled to one another when the golf club is in the first configuration, said first spacer being threadably coupled to the first and second sections when the golf club is in the second configuration.

3. The extendable golf club of claim 1, said male projection presenting a pair of spaced-apart sloping sidewalls at least partly defining the recess, said set screw engaging at least one of the sloping sidewalls when the golf club is in the second configuration.

4. The extendable golf club of claim 1, said male projection including an unthreaded portion proximate the first end of the barrel and a threaded portion spaced from the first end of the barrel, said recess being formed in the unthreaded portion.

5. The extendable golf club of claim 1, said second section of the shaft including a male end portion having substantially the same configuration as the male projection of the first spacer.

6. The extendable golf club of claim 5, said female opening of the first spacer threadably receiving the male end portion of the second section when the golf club is in the second configuration.

7. The extendable golf club of claim claim 4, said first spacer including an adhesive capsule disposed in the female opening.

8. The extendable golf club of claim 7, said adhesive capsule including a non-liquid shell sealingly containing a liquid adhesive, said shell being automatically ruptured to thereby release the liquid adhesive when the golf club is shifted from the first configuration to the second configuration.

9. The extendable golf club of claim 8, said liquid adhesive being operable to permanently couple the first spacer to the second section of the shaft after the golf club has been shifted into the second configuration.

10. The extendable golf club of claim 1, said barrel of said first spacer presenting a substantially smooth, generally cylindrical outer barrel surface.

11. The extendable golf club of claim 10, said outer barrel surface having generally the same diameter as the first and second sections of the shaft proximate the outer barrel surface when the golf club is in the second configuration.

12. The extendable golf club of claim 1; and a second spacer for further lengthening the shaft relative to the second configuration, said golf club being shiftable from the second configuration wherein the second spacer is entirely detached and spaced from the shaft to a third configuration wherein the second spacer is coupled between the first section and the first spacer to thereby lengthen the shaft relative to the second configuration, said set screw engaging the second spacer when the golf club is in the third configuration, thereby releasably coupling the first section and the second spacer to one another.

13. The extendable golf club of claim 12, said first and second sections being threadably coupled to one another when the golf club is in the first configuration, said first spacer being threadably coupled between the first and second sections when the golf club is in the second configuration, said second spacer being threadably coupled between the first section and the first spacer when the golf club is in the third configuration.

14. The extendable golf club of claim 13, said first and second spacers being substantially identical.

15. The extendable golf club of claim 1; and a golf club head coupled to the second section; and a golf club grip coupled to the first section.

16. The extendable golf club of claim 15, said second section being at least twice as long as the first section.

17. The extendable golf club of claim 1, said first and second sections being configured to substantially prevent telescopic extension or retraction of the shaft.

18. An extendable golf club comprising:

a shaft including first and second sections; and a first spacer for lengthening the shaft, said golf club being shiftable from a first configuration wherein the first spacer is entirely detached and spaced from the shaft to a second configuration wherein the first spacer is threadably coupled between the first and second sections to thereby lengthen the shaft relative to the first configuration, said first and second sections being threadably intercoupled when the golf club is in the first configuration, said first spacer including an adhesive capsule when the golf club is in the first configuration, said adhesive capsule adapted to rupture when the golf club is shifted from the first configuration to the second configuration to thereby permanently couple the first spacer to the second section, said first spacer including a barrel portion presenting first and second ends, said first spacer including a male projection extending from the first end of the barrel, said first spacer defining a female opening extending inwardly from the second end of the barrel, said adhesive capsule being received in the female opening, said second section presenting a male end portion threadably received in the female opening of the first spacer when the golf club is in the second configuration, said male end portion adapted to automatically rupture the adhesive capsule when the golf club is shifted from the first configuration to the second configuration, said shaft including a set screw threadably received in the first section, said male end portion defining a circumferential recess, said set screw engaging the male end portion and received in the recess when the golf club is in the first configuration, thereby releasably coupling the first and second sections to one another.

19. The extendable golf club of claim 18, said adhesive capsule including a non-liquid shell sealingly containing a liquid epoxy, said non-liquid shell being ruptured by the male end portion when the golf club is shifted from the first configuration to the second configuration, said epoxy being operable to permanently lock the male end portion in the female opening.

20. The extendable golf club of claim 18, said male projection of the first spacer being substantially identical to the male end portion of the second section, said set screw engaging the male projection of the first spacer when the golf club is in the second configuration.

21. The extendable golf club of claim 20; and a second spacer for further lengthening the shaft relative to the second configuration, said golf club being shiftable from the second configuration wherein the second spacer is entirely detached and spaced from the shaft to a third configuration wherein the second spacer is threadably coupled between the first section and the first spacer to thereby lengthen the shaft relative to the second configuration, said second spacer being substantially identical to the first spacer.

22. The extendable golf club of claim 21; and a golf club head coupled to the second section; and a golf club grip coupled to the first section.

23. The extendable golf club of claim 22, said second section being at least twice as long as the first section.

24. The extendable golf club of claim 23, said first section, second section, first spacer, and second spacer being non-telescopically intercoupled.

* * * * *